United States Patent [19]

Black et al.

[11] 4,108,275

[45] Aug. 22, 1978

[54] MUFFLER

[76] Inventors: William M. Black, 251 Longley Way; R. Bruce McCallum, 1730 Alta Oaks Dr., both of Arcadia, Calif. 91006

[21] Appl. No.: 801,905

[22] Filed: May 31, 1977

[51] Int. Cl.[2] ..... F01N 1/04

[52] U.S. Cl. ..... 181/252

[58] Field of Search ..... 181/231, 252, 256, 247, 181/264, 279, 280

[56] References Cited

U.S. PATENT DOCUMENTS

| | | | |
|---|---|---|---|
| 2,646,854 | 7/1953 | Walker | 181/280 |
| 3,765,506 | 10/1973 | Strunk | 181/252 |
| 3,884,655 | 5/1975 | Coop | 181/231 |

*Primary Examiner*—Robert C. Watson
*Attorney, Agent, or Firm*—John J. Posta, Jr.

[57] ABSTRACT

The improved engine exhaust gas muffler of the invention comprises an outer hollow tubular elongated shell having a gas inlet and a gas outlet at opposite ends thereof, and a hollow perforated tubular extension secured to the inlet end of the shell and extending part way along the length of the shell substantially coaxially therewith. A hollow perforated insert substantially coaxial with the shell and having an upstream end slip fitted within the downstream end of the extension and a downstream end either connected to the shell gas outlet or fitted within a lower extension is also provided. The insert's upstream end has a terminal portion of smaller diameter than the main body of the insert so as to form with the extension downstream end means for diverting exhaust gases flowing through the muffler into a plurality of paths for better sound attenuation, and also a pocket for the accumulation of solid particles from exhaust gases without plugging of said paths.

Sound deadening, preferably heat insulating, means are disposed in the shell around the exterior of the extension and also that portion of the insert which is outside of the extension. The slip fit between the extension and insert permits heat expansion of these components without degrading the muffler. The muffler is inexpensive and has improved sound deadening properties and improved durability.

12 Claims, 2 Drawing Figures

MUFFLER

BACKGROUND OF THE INVENTION

1. Field of the Invention

The present invention generally relates to sound deadening means and more particularly to improved mufflers for engines, such as auto engines and the like.

2. Prior Art

The sudden rush of gases at elevated pressure from each cylinder of an operating internal combustion engine or the like amounts to explosive expansion of the gas and results in a loud unpleasant sound. Mufflers are connected in the engine exhaust tubing for the purpose of muffling this sound by delaying the gas expansion and thus reducing the cause of the noise. The simplest form of muffler is a conically shaped tube of expanding proportions. However, to be effective, its length must be very long. Accordingly, most auto vehicle mufflers are shortened in length and employ various complicated means to retard the gas flow and thus deaden the engine noise. Many of such mufflers are expensive and subject to heat deterioration, due to expansion and contraction of rigidly interconnected components at high temperatures. It therefore would be desirable to provide an improved inexpensive muffler having increased efficiency, compactness and durability.

SUMMARY OF THE INVENTION

The foregoing needs have been satisfied by the improved muffler of the present invention. The muffler is substantially as set forth in the Abstract above. It includes an outer shell with a perforated extension tube extending into the shell from one end and a perforated insert extending into the shell and the extension from the opposite end. The opposite end of the insert can be connected directly to the opposite end of the shell or can be slideably fitted into a second, solid extension attached to the opposite end of the shell. The upstream end of the insert is reduced in diameter to deflect a portion of inflowing gases out through the sidewall of the extension for return downstream in the insert. This arrangement is very durable, inexpensive and efficient, and can operate at elevated and diverse temperatures without heat degradation. In this regard, its extensions and insert components are slip fitted together for free expansion and contraction. Moreover, the muffler's improved means for splitting gases through the muffler into a plurality of streams with different intersecting paths more readily attenuates the engine sounds.

The muffler also provides a pocket which can receive solid particles such as carbon entrained in the exhaust gas stream, and thus permit the continued free non-plugging passage of the gases through the muffler. The shell and the extensions and insert of the muffler can be of any suitable temperature resistant material, as can the sound deadening thermal insulating packing or the like in the shell exterior of the insert and extension. Further features of the muffler of the present invention are set forth in the following detailed description and accompanying drawings.

DRAWINGS

FIG. 1 is a schematic fragmentary side elevation, partly broken away of a first preferred embodiment of the improved muffler of the present invention; and FIG. 2 is a schematic fragmentary side elevation, partly broken away, of a second preferred embodiment of the improved muffler of the present invention.

DETAILED DESCRIPTION

FIG. 1

Figure 1:
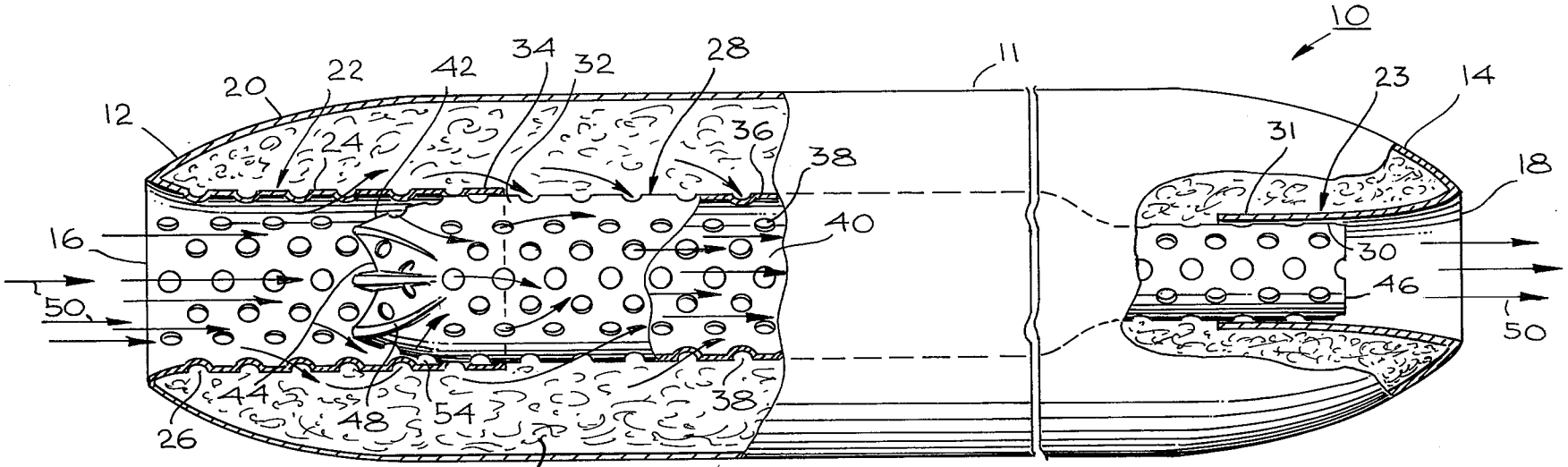

Now referring more particularly to FIG. 1 of the accompanying drawings, a first preferred embodiment of the improved muffler of the invention is shown schematically in side elevation therein. Thus, a muffler 10 is shown which comprises a hollow, elongated and preferably generally cylindrical shell 11 preferably an inlet end 12 which is coned down and a similarly coned down outlet end 14. Inlet end 12 defines an inlet 16 while outlet end 14 defines an outlet 18. Inlet 16 and outlet 18 are aligned along the longitudinal axis of shell 11. At inlet end 12 the sidewall 20 of shell 11 is secured to the upstream end of a hollow, tubular, generally cylindrical, elongated extension 22 which extends within shell 11 for a portion of the length of shell 11 and is concentric therewith. The sidewall 24 of extension 22 is provided with a plurality of spaced perforations 26 therethrough. Extension 22, as shown in FIG. 1, may be somewhat flared at inlet end 12, if desired, and/or reduced at outlet end, if desired.

A second, solid, hollow, tubular, generally cylindrical, elongated extension 23 is secured at its downstream end to shell 11 and extends into shell 11 for a portion of the length of shell 11 and is concentric therewith.

A hollow, tubular, generally cylindrical, elongated insert 28 is located entirely inside of and coaxially with shell, with its upstream end 32 within the downstream end 34 of extension 22, and its downstream end 30 within the upstream end 31 of second extension 23, as shown in FIG. 1. The sidewall 36 of insert 28 defines a plurality of spaced perforations 38 extending therethrough. Insert 28 slip fits within extensions 22 and 23 so as to allow the components to freely expand and contract while being joined together to define a gas passageway 40 extending the length of shell 11 along the longitudinal axis thereof from inlet 16 to outlet 18.

If desired, the ends of insert 28 can be swaged to increase or decrease the diameter thereof with respect to the mid-portion of insert 28 so as to render a snug fit within extensions 22 and 23.

Figure 2:
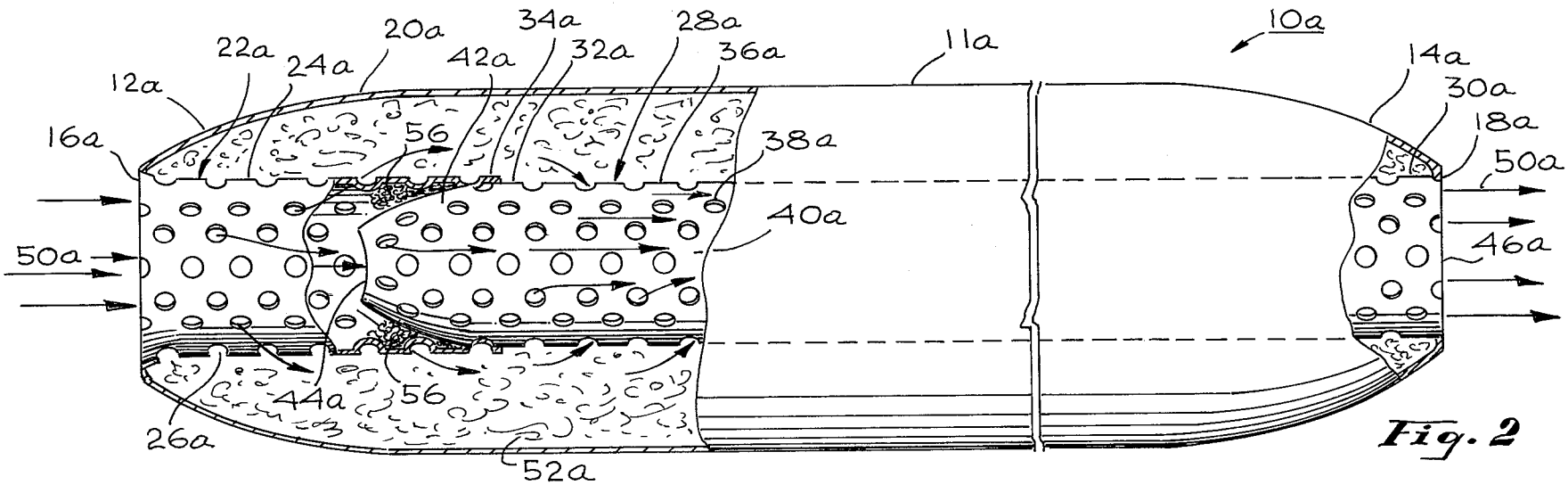

Alternatively, insert 28 can be substantially the same diameter along substantially its entire length as shown in FIG. 2, or its diameter can be significantly reduced at its downstream end 46 relative to its upstream end 32, in stepped down fashion, as shown in FIG. 1. Likewise, the diameters of opposite ends of insert 28 can be increased or decreased in size with respect to one another, in a stepped-down, stepped-up, or continuously increasing or decreasing fashion (not shown) without departing from the scope of the invention.

End 32 of insert 28 includes a terminal portion 42 which is of reduced diameter relative to the remainder of insert 28. In this regard, inlet 44 of insert 28 is made smaller than outlet 46 thereof. This can be accomplished by pinching or squeezing down portion 42 so that a plurality of outwardly and forwardly directed projections 48 are formed therein, as shown in FIG. 1. Preferably, projections 48 are disposed at about 90° from each other around the exterior of insert 28 in portion 42. They have the effect, together with the reduced size of inlet 44, of causing a portion of the exhaust gases 50 entering shell 11 and passing downstream in extension 22 to be diverted into a plurality of elongated paths. Thus, such gases tend to be deflected outwardly through perforations 26 in extension 22 into the area, adjacent thereof; which area is filled with a suitable sound deadening, heat insulating packing material 52, such as fiberglass, asbestos or the like. Such deflected gases flow downstream and then pass back into passageway 40 through perforations 38 either in portion 42 or downstream thereof. Such gases intersect, interrupt and impinge upon the gases flowing straight down passageway 40, causing gas turbulence and delay of gas passage and resulting in substantially improved sound attenuation (deadening). Thus, shell 11 can be relatively short and still achieve superior sound deadening results.

Moreover, a pocket 54 is formed between portion 42 of insert 28 and the adjacent portion of sidewall 24 of extension 22, within which solid particles, such as carbon, which may be entrained in gases 50, can be trapped and removed. Build-up of a deposit of such particles in pocket 54 merely adds in diverting a portion of gases 50 into the desired plurality of elongated gas streams described above and prevents undesired plugging in passageway 40.

Shell 11, extensions 22 and 23 and insert 28 can be inexpensively and rapidly made of steel, high temperature aluminum or other suitable metal, or even of ceramic or other suitable high temperature non-metallic materials, or combinations thereof, as desired, to improve the described improved results.

FIG. 2

A second preferred embodiment of the improved muffler of the present invention is schematically depicted in FIG. 2. The muffler of FIG. 2 is generally similar to muffler 10. Accordingly, all components of the muffler of FIG. 2 which are substantially identical to those of muffler 10 bear the same numerals but are succeeded by the letter "*a*". In this regard, FIG. 2 depicts a muffler 10*a* which comprises a shell 11*a* with the sidewall 20*a* thereof coned down at an inlet end 12*a* to define an inlet 16*a* and at an opposite outlet end 14*a* to define an outlet 18*a*.

Muffler 10*a* has an extension 22*a* secured thereto and extending inwardly thereof as described for extension 22. The upstream end 32*a* of an insert 28*a* slip fits inside the downstream end 34*a* of extension 22*a*, while the downstream end 30*a* of insert 28*a* slip fits into the upstream end of extension 23. Insert 28*a* and extension 22*a* together form a gas passageway 40*a* extending down the center of muffler 10 along the length thereof from inlet 16*a* to outlet 18*a*, as shown in FIG. 2.

The sidewall 24*a* of extension 22*a* contains spaced perforations 26*a* therethrough, and sidewall 36*a* of insert 28*a* contains perforations 38*a* therethrough. The terminal portion 42*a* of end 32*a* is coned down so that inlet 44*a* of insert 28*a* is smaller than its outlet 46*a*. A pocket 54*a* is thus formed between portion 42*a* and the adjacent sidewall 24*a* of extension 22*a* within which solid particles 56 entrained in exhaust gases 50*a* passing through muffler 10*a* can settle out without plugging passageway 40*a*.

As can be seen from the arrows of FIG. 2, exhaust gases 50*a* pass into muffler 10*a* through inlet 16*a*, then through extension 22*a*. However, as they encounter portion 42*a*, a first portion of such gases passes straight through insert 28*a*, while the remaining portion is deflected as a series of separate streams out through perforations 26*a*, into insulation 52*a* around extension 22*a* and insert 28*a* within shell 11*a*, then downstream and then back into passageway 40*a* through perforations 38*a* in insert 28*a*, intersecting the first portion of gases 50*a* and causing turbulence, gass passage delay and effective sound impedance, all within the short span of muffler 10*a*. The sum total of gases 50*a* finally exit muffler 10*a* through outlet 18*a*. Perforations 38*a* permit some divergences of gases 50*a* into and out of passageway 40*a* along the whole length of insert 28*a* for most effective sound deadening.

Muffler 10*a* can be fabricated easily, rapidly, inexpensively and durably of materials similar to those specified for muffler 10 to provide comparable characteristics and advantages. However, various modifications, changes, alterations and additions can be made in the improved muffler of the present invention, in its components, and in their shape, size, interconnection, materials of construction and other parameters. All such modifications, changes, alterations and additions as are within the scope of the appended claims form part of the present invention.

What is claimed is:

1. An improved engine exhaust gas muffler, said muffler comprising, in combination:
   a. an outer hollow tubular elongated shell having a gas inlet and a gas outlet;
   b. a hollow perforated tubular extension secured and open to the inlet end of said shell and extending within said shell along only a portion of the length thereof substantially coaxially with said shell;
   c. a hollow perforated tubular insert having an open upstream free end slideably disposed within the downstream end of said extension and having a downstream end terminating adjacent to the gas outlet end of said shell, said insert being substantially coaxial with said shell, said upstream end of said insert having a terminal portion of smaller diameter than the main body of said insert so as to form with said extension downstream end means for diverting gases, when passing through said shell into a plurality of elongated paths; and,
   d. sound deadening means within said shell outside of said extension and insert.

2. The improved muffler of claim 1 wherein said upstream end of said insert is crimped to provide said smaller diameter and a plurality of gas path-diverting projections.

3. An improved engine exhaust gas muffler, said muffler comprising, in combination:
   a. an outer hollow tubular elongated shell having a gas inlet and a gas outlet;
   b. a hollow perforated tubular extension secured to the inlet end of said shell and extending within said shell along a portion of the length thereof substantially coaxially with said shell;
   c. a hollow perforated tubular insert having an upstream end slideably disposed within the downstream end of said extension and having a downstream end terminating adjacent to the gas outlet end of said shell, said insert being substantially coaxial with said shell, said upstream end of said insert having a terminal portion of smaller diameter than the main body of said insert so as to form with said extension downstream end a solid particle-trapping pocket and also means for diverting gases, when passing through said shell into a plurality of elongated paths; and, d. sound deadening means within said shell outside of said extension and insert, said upstream end of said insert being crimped to provide said smaller diameter and a plurality of gas path-diverting projections.

4. The improved muffler of claim 3 wherein said upstream end of said insert is coned down.

5. The improved muffler of claim 4 wherein said insert and extension comprise readily heat expandable material and wherein said slip fit between said extension and insert permits the non-interfering heat expansion.

6. The improved muffler of claim 5 wherein said shell, extension and insert are of metal and said sound deadening material comprises fiberglass.

7. The improved muffler of claim 4 wherein said shell is coned down at said inlet and at said outlet, wherein said inlet and outlet are at opposite ends of said shell and wherein said extension perforations and insert perforations are sound attenuating.

8. The improved muffler of claim 3 wherein said projections comprise four wings disposed at about 90° from each other.

9. The improved muffler of claim 3 including a second hollow, tubular extension secured to the outlet end of said shell and extending within said shell along a portion of the length thereof substantially coaxially with said shell, wherein the downstream end of said insert is slideably positioned within said second extension for free expansion therein.

10. The improved muffler of claim 9 wherein said second extension is solid.

11. The improved muffler of claim 3 wherein the downstream end of said insert is secured to the shell at the gas outlet.

12. The improved muffler of claim 3 wherein diameter of said insert varies along the length thereof.

* * * * *